US010297407B2

(12) United States Patent
Tsutsumi et al.

(10) Patent No.: US 10,297,407 B2
(45) Date of Patent: May 21, 2019

(54) ELECTROMAGNETIC CONTACTOR

(71) Applicant: FUJI ELECTRIC FA COMPONENTS & SYSTEMS CO., LTD., Tokyo (JP)

(72) Inventors: Takashi Tsutsumi, Kouosu (JP); Masaaki Watanabe, Kouosu (JP); Hideki Daijima, Kouosu (JP); Shota Shiinoki, Kouosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 435 days.

(21) Appl. No.: 15/159,284

(22) Filed: May 19, 2016

(65) Prior Publication Data

US 2016/0260564 A1 Sep. 8, 2016

Related U.S. Application Data

(63) Continuation of application No. PCT/JP2015/001946, filed on Apr. 7, 2015.

(30) Foreign Application Priority Data

May 20, 2014 (JP) ..... 2014-104748

(51) Int. Cl.
*H01H 9/00* (2006.01)
*H01H 50/30* (2006.01)
*H01H 50/44* (2006.01)

(52) U.S. Cl.
CPC ..... *H01H 50/30* (2013.01); *H01H 50/305* (2013.01); *H01H 50/443* (2013.01)

(58) Field of Classification Search
CPC ..... H01H 50/30; H01H 45/04
(Continued)

(56) References Cited

U.S. PATENT DOCUMENTS 3,409,851 A * 11/1968 Scheib, Jr. ..... H01H 50/22 335/126
3,651,437 A * 3/1972 Kiyoshi ..... H01H 50/22 335/131

(Continued)

FOREIGN PATENT DOCUMENTS

CN 103646824 A 3/2014
JP 6-196071 7/1994

(Continued)

OTHER PUBLICATIONS

International Search Report dated May 12, 2015, in corresponding International Application No. PCT/JP2015/001946.

(Continued)

*Primary Examiner* — Shawki S Ismail
*Assistant Examiner* — Lisa N Homza

(57) ABSTRACT

An electromagnetic contactor in which a shock-absorbing member is integrally formed in a frame. The electromagnetic contactor includes a first frame in which an operating electromagnet is disposed and coil terminals which supply power to a coil of the electromagnet is formed to project from a side surface, and a second frame in which a contact mechanism having an auxiliary contact is disposed and has power source side terminals on one end side and load side terminals on the other end side, and in the first frame and the second frame, a snap fit is formed which can attach the second frame to the first frame in both of a normal direction coupled state where the coil terminals and the power source side terminals face the same direction and a reverse direction coupled state in which the coil terminals and the load side terminals face the same direction.

4 Claims, 8 Drawing Sheets

(58) Field of Classification Search
USPC ..... 335/177
See application file for complete search history.

(56) References Cited

U.S. PATENT DOCUMENTS

| | | | | | |
|---|---|---|---|---|---|
| 3,873,952 | A * | 3/1975 | Kondo | H01H 50/22 | 335/132 |
| 4,345,224 | A * | 8/1982 | Lenzing | H01H 1/2008 | 29/602.1 |
| 4,345,225 | A * | 8/1982 | Lemmer | H01H 50/02 | 335/132 |
| 4,489,296 | A * | 12/1984 | Guery | H01H 1/20 | 200/243 |
| 4,647,886 | A * | 3/1987 | Schmiedel | H01H 50/22 | 335/132 |
| 4,760,364 | A * | 7/1988 | Ostby | H01H 50/22 | 200/293 |
| 4,947,146 | A * | 8/1990 | Ichimura | H01H 50/34 | 335/131 |
| 5,087,903 | A * | 2/1992 | Chiu | H01H 51/005 | 335/128 |
| 5,243,313 | A * | 9/1993 | Basnett | H01H 50/163 | 335/131 |
| 5,880,658 | A * | 3/1999 | Donhauser | H01H 77/06 | 218/155 |
| 6,111,488 | A * | 8/2000 | Nakamura | H01H 50/045 | 335/132 |
| 6,239,679 | B1 * | 5/2001 | Comtois | H01H 50/042 | 335/127 |
| 7,375,606 | B2 * | 5/2008 | Talon | F02N 15/067 | 335/126 |
| 7,692,522 | B2 * | 4/2010 | Hartinger | H01H 1/0015 | 335/131 |
| 7,902,947 | B2 * | 3/2011 | Lefebvre | H01H 50/021 | 335/132 |
| 8,324,992 | B2 * | 12/2012 | Kurashige | H01H 50/305 | 335/128 |
| 8,324,993 | B2 * | 12/2012 | Naka | H01H 50/045 | 335/132 |
| 8,378,767 | B2 * | 2/2013 | Okubo | H01H 50/323 | 335/128 |
| 8,410,877 | B1 * | 4/2013 | Takaya | H01H 50/045 | 335/129 |
| 8,514,041 | B2 * | 8/2013 | Naka | H01H 50/323 | 335/131 |
| 8,653,916 | B2 * | 2/2014 | Naka | H01H 50/30 | 335/131 |
| 8,816,801 | B2 * | 8/2014 | Tachikawa | H01H 1/54 | 335/131 |
| 2006/0125581 | A1 * | 6/2006 | Ohkubo | H01H 50/305 | 335/132 |
| 2006/0152311 | A1 * | 7/2006 | Ohkubo | H01H 9/342 | 335/132 |
| 2008/0074215 | A1 * | 3/2008 | Zhou | H01H 1/0015 | 335/132 |
| 2012/0056701 | A1 * | 3/2012 | Takaya | H01H 50/045 | 335/185 |
| 2015/0022291 | A1 * | 1/2015 | Kashimura | H01H 9/443 | 335/131 |
| 2015/0022292 | A1 * | 1/2015 | Tachikawa | H01H 50/54 | 335/131 |
| 2015/0035631 | A1 * | 2/2015 | Inaguchi | H01H 9/48 | 335/133 |
| 2016/0260564 | A1 * | 9/2016 | Tsutsumi | H01H 50/30 | |
| 2016/0365211 | A1 * | 12/2016 | Tsutsumi | H01H 45/04 | |

FOREIGN PATENT DOCUMENTS

| | | |
|---|---|---|
| JP | 7-6680 | 1/1995 |
| JP | 2000-11832 | 1/2000 |
| JP | 2010-282834 | 12/2010 |
| JP | 2012-128993 | 7/2012 |

OTHER PUBLICATIONS

International Preliminary Report on Patentability dated Dec. 1, 2016 in corresponding to International Patent Application No. PCT/JP2015/001946.

Chinese Office Action dated Mar. 20, 2017 in corresponding Chinese Patent Application No. 201580002959.1.

* cited by examiner

ELECTROMAGNETIC CONTACTOR

CROSS-REFERENCE TO RELATED APPLICATIONS

This application is a continuation application filed under 35 U.S.C. § 111(a), of International Application PCT/JP2015/001946, filed Apr. 7, 2015, and claims foreign priority benefit to Japanese Patent Application No. 2014-104748, filed May 20, 2014, the contents of which are incorporated herein by reference.

TECHNICAL FIELD

The present invention relates to an electromagnetic contactor including an operating electromagnet having a fixed core and a movable core, more particularly to an electromagnetic contactor which absorbs shock when a movable core collides with a fixed core.

BACKGROUND ART

As an electromagnetic contactor including this type of operating electromagnet, for example, a conventional example described in Patent Literature 1 is known.

In Patent Literature 1, a fixed core is disposed via an elastic member made of a shock-absorbing rubber in a fixed insulating base, and the fixed core is positively moved toward a movable core during driving by an electromagnetic coil, thereby decreasing a relative collision speed to improve mechanical durability of the movable core and the fixed core.

CITATION LIST

Patent Literature

PTL 1: JP 2010-282834 A

SUMMARY OF INVENTION

Technical Problem

However, in a conventional example described in Patent Literature 1 mentioned above, an elastic member made of a shock-absorbing rubber disposed in a bottom portion of a fixed insulating base is disposed as a shock-absorbing material, and hence there are unsolved problems that the shock-absorbing material is separately required, the number of components increases, and manufacturing cost also increases.

Thus, the present invention has been developed in view of the unsolved problems of the above conventional example, and an object thereof is to provide an electromagnetic contactor in which a shock-absorbing member is integrally formed in a frame, whereby a shock-absorbing effect can be exerted while decreasing the number of components.

Solution to Problem

To achieve the above object, one configuration of an electromagnetic contactor according to the present invention includes a first frame and a second frame which are made of a synthetic resin and coupled with each other, an operating electromagnet in which a fixed core is fixed in the first frame and a movable core is disposed in the second frame, and a shock-absorbing rib integrally formed in a bottom portion of a bottomed tubular section of the first frame to support the fixed core of the operating electromagnet.

Advantageous Effects of Invention

According to the present invention, a shock-absorbing rib which supports a fixed core is formed in a bottom portion of a first frame, and hence a separate shock-absorbing member does not have to be disposed between the fixed core and the bottom portion of the first frame, and a shock-absorbing effect can be exerted while decreasing the number of components.

BRIEF DESCRIPTION OF DRAWINGS

FIG. 9A is a front view, FIG. 9B is a side view, and FIG. 9C is a back view.

DESCRIPTION OF EMBODIMENTS

One embodiment of the present invention will now be described with reference to the drawings.

Figure 1:
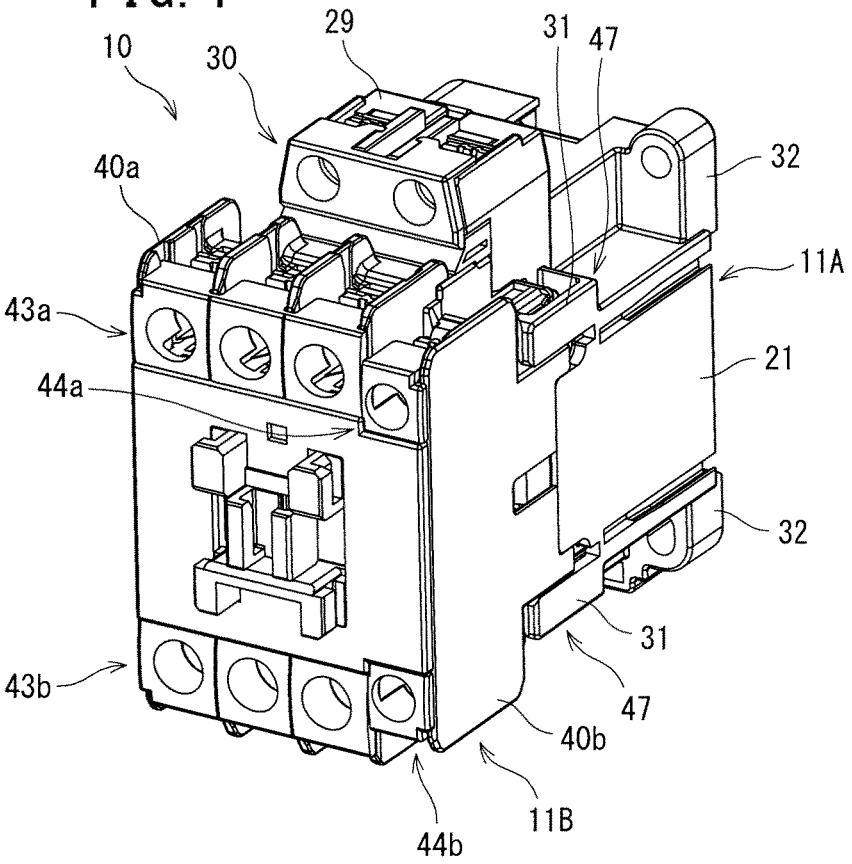
FIG. 1 is an appearance perspective view illustrative of an electromagnetic contactor according to the present invention.

As illustrated in FIG. 1, an electromagnetic contactor 10 according to the present invention is constituted a first frame 11A and a second frame 11B which are made of a synthetic resin material such as polybutylene terephthalate (PBT) and coupled with each other.

Figure 2:
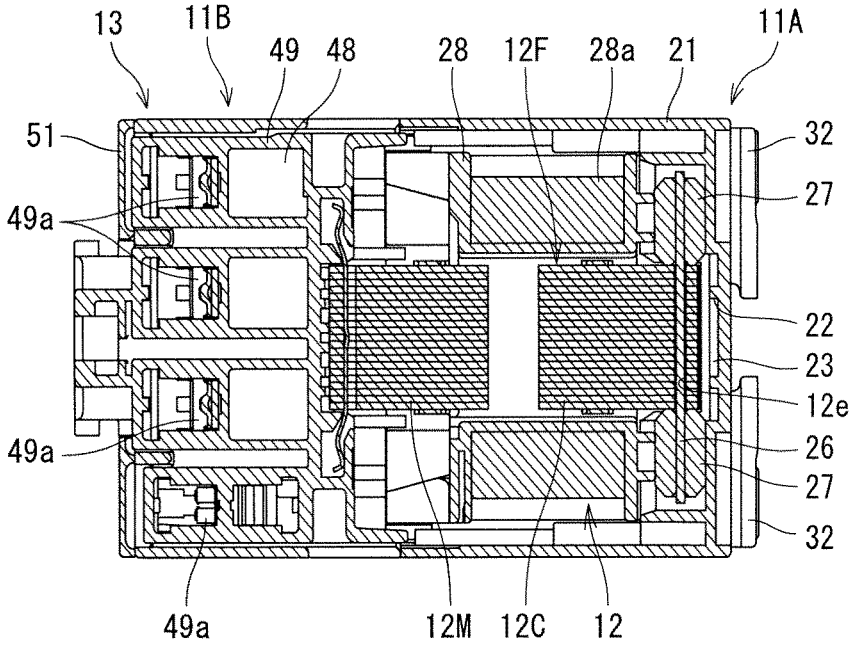
FIG. 2 is a transverse cross-sectional view of FIG. 1.
Figure 4:
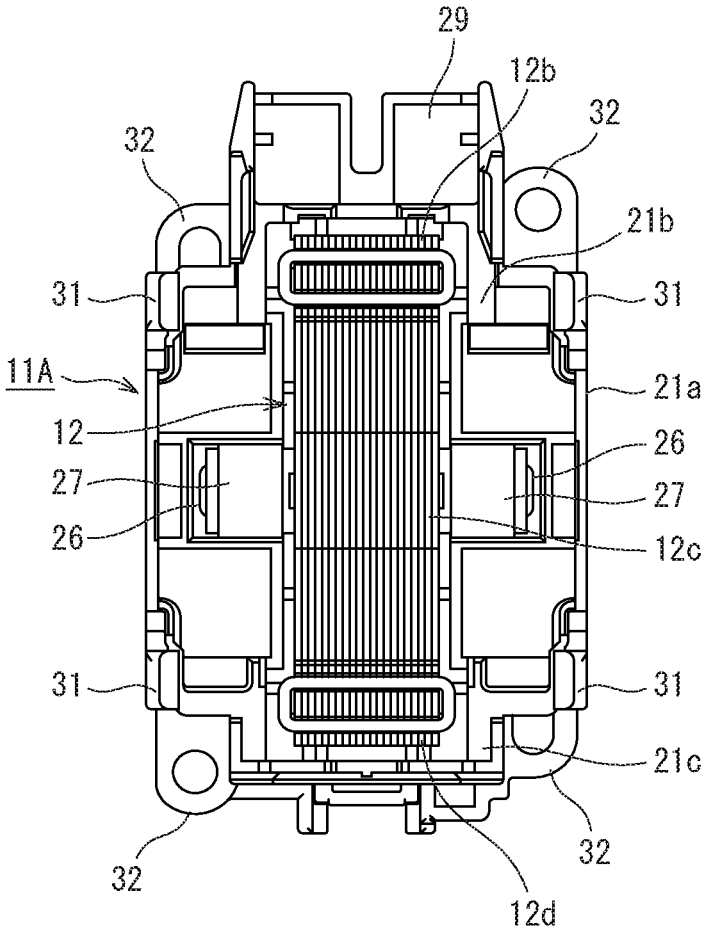
FIG. 4 is a front view in which a fixed core of the first frame is attached.
Figure 5:
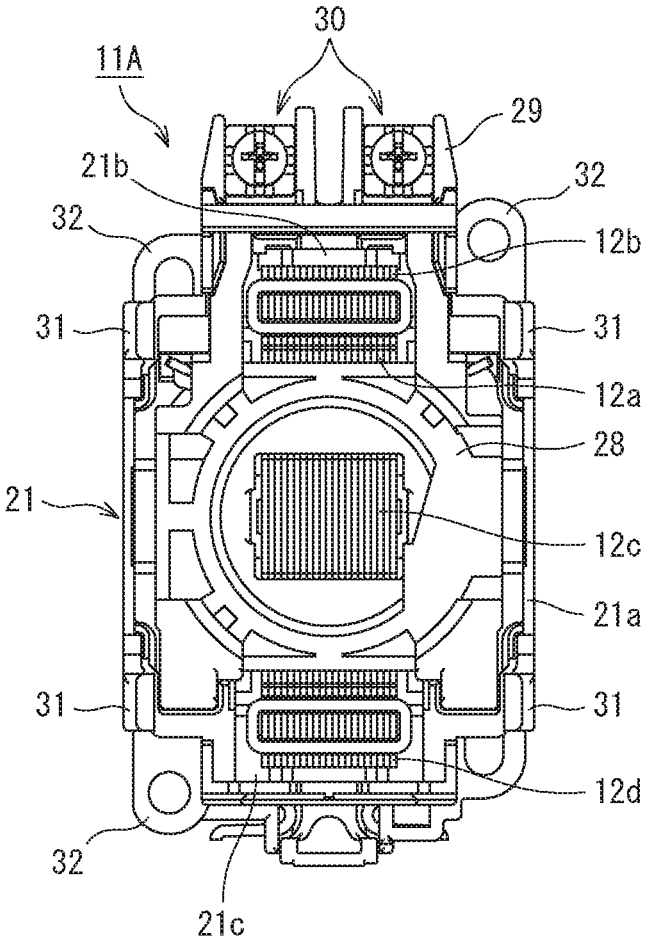
FIG. 5 is a front view in which a spool of the first frame is attached.
Figure 6:
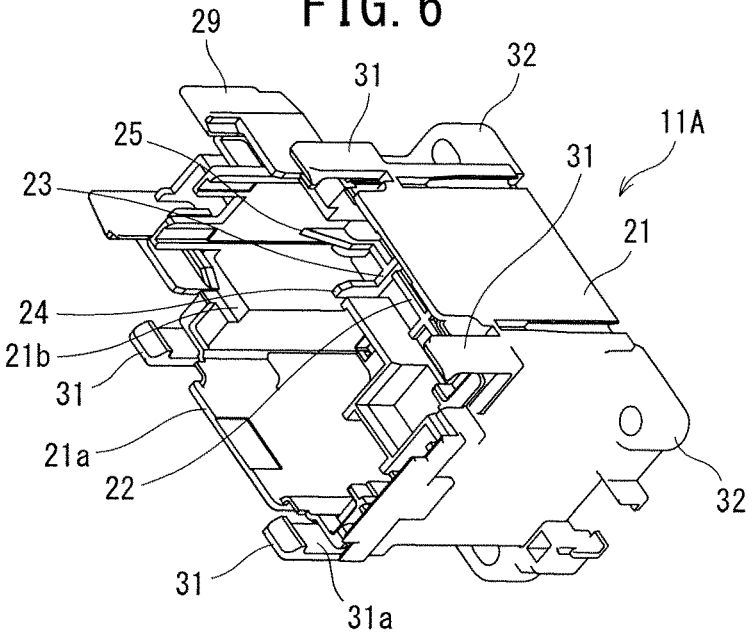
FIG. 6 is a perspective view of the first frame.

In the first frame 11A, as illustrated in FIG. 2, FIG. 4 and FIG. 6, an operating electromagnet 12 is disposed. In the second frame 11B, as illustrated in FIG. 2, there is disposed a contact mechanism 13 driven to be on and off by the operating electromagnet 12.

Figure 3:
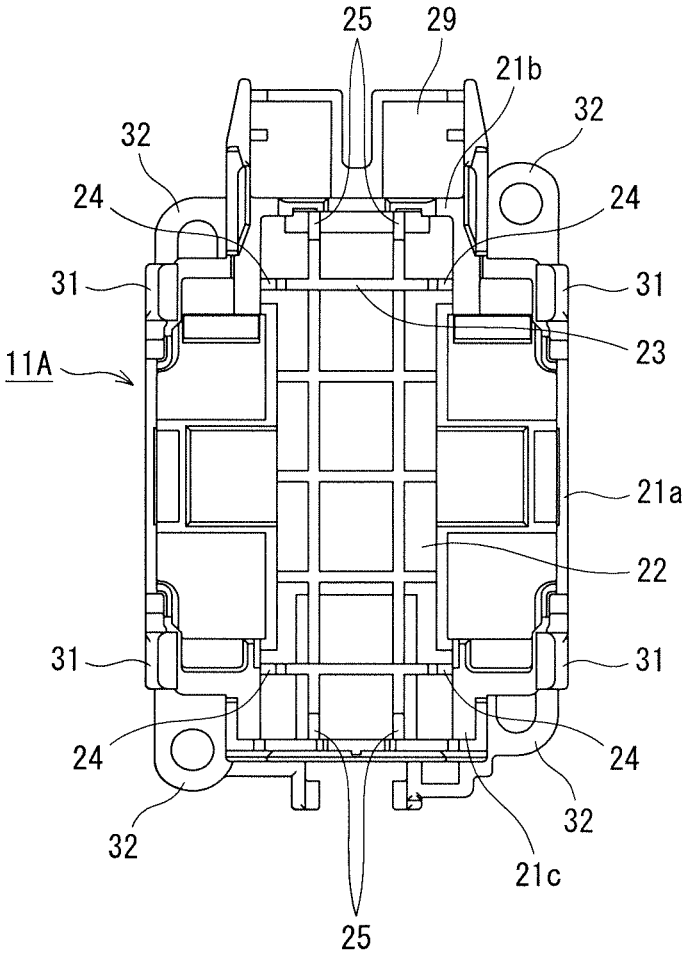
FIG. 3 is a front view of a first frame.

The first frame 11A has a bottomed square tubular section 21 containing the operating electromagnet 12. As seen from a front and illustrated in FIG. 3, the bottomed square tubular section 21 is constituted of a wide portion 21*a* of a central portion, and narrow portions 21*b* and 21*c* disposed on one pair of facing side walls, for example, upper and lower side walls of the wide portion 21*a* and formed vertically linearly symmetrically based on a central axis of an upward-downward direction of the wide portion 21*a* to communicate with the wide portion 21*a*. Further, on a bottom surface between the narrow portion 21*b* and the narrow portion 21*c* between which the wide portion 21*a* is sandwiched, latticed reinforcing ribs 22 which reinforce a bottom plate portion of the bottomed square tubular section 21 are integrally formed.

Figure 8:
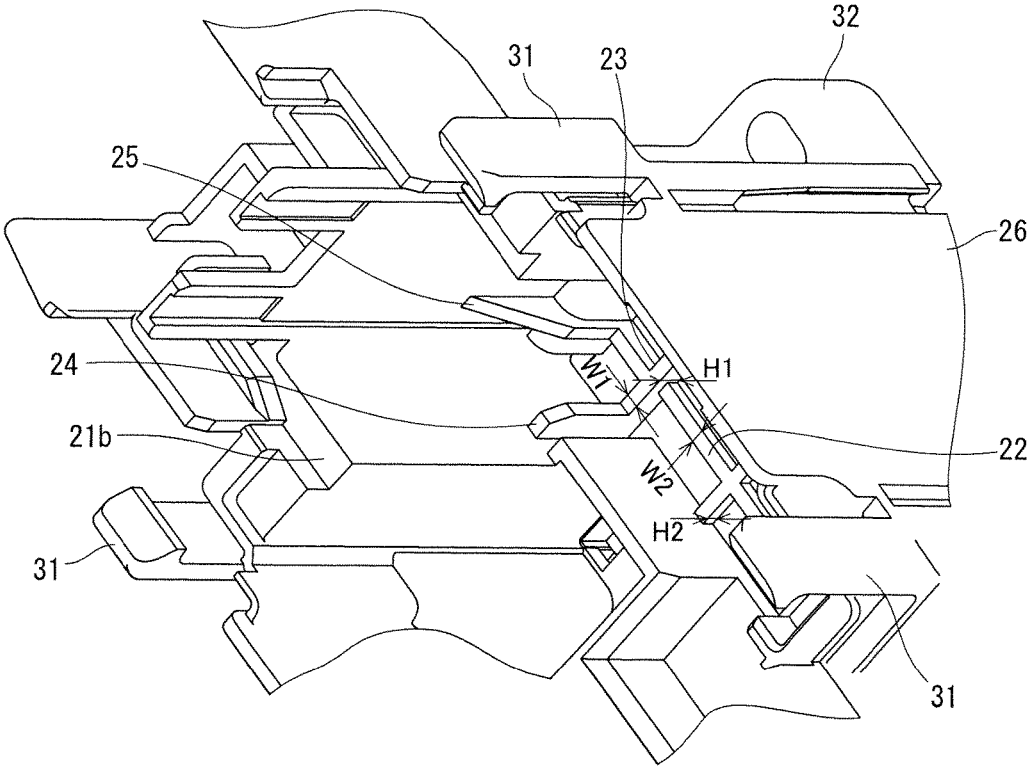
FIG. 8 is an enlarged perspective view illustrative of shock-absorbing ribs of the first frame.

Ribs extending in a right-left direction on upper and lower end portion sides of the reinforcing ribs 22 are defined as shock-absorbing ribs 23 which support a fixed core 12F of the operating electromagnet 12. As illustrated in FIG. 6 and FIG. 8, a width W1 of the shock-absorbing ribs 23 is set to be smaller than a width W2 of the other reinforcing ribs 22 and a height H1 of the shock-absorbing ribs is set to be higher than a height H2 of the other reinforcing ribs 22. Consequently, the shock-absorbing ribs 23 are constituted to be easy to bend, thereby exerting a shock-absorbing function as compared with the reinforcing ribs 22. Additionally, guide members 24 which project forward to guide the fixed core 12F are integrally formed in right and left end portions of the shock-absorbing ribs 23, and guide members 25 which guide the fixed core 12F are also integrally formed in upper and lower end portion sides of the shock-absorbing ribs.

Figure 7:
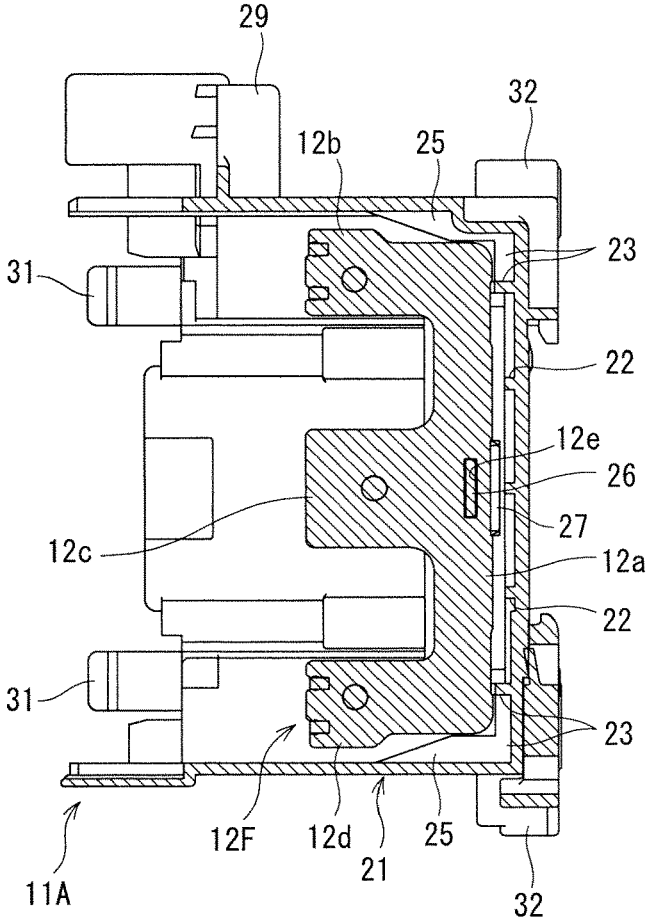
FIG. 7 is a vertical cross-sectional view of the first frame.

Further, the fixed core 12F constituting the operating electromagnet 12 is supported on the shock-absorbing ribs 23. As illustrated in FIG. 7, the fixed core 12F has an E-shape by forming projecting portions 12*b* to 12*d* in an upper end portion, a central portion and a lower end portion of a coupling plate portion 12*a* extending in the upward-downward direction.

In the fixed core 12F, a support plate 26 is inserted into a through hole 12*e* formed at a position that faces the central projecting portion 12*c* of the coupling plate portion 12*a*, and both right and left end portions of the support plate 26 which project from the coupling plate portion 12*a* are inserted into elastic members 27, respectively, as illustrated in FIG. 2.

As illustrated in FIG. 2, the elastic members 27 are sandwiched between a spool 28 which is attached to a periphery of the central projecting portion 12*c* of the fixed core 12F and around which an energization coil 28*a* is wound and the bottom portion of the bottomed square tubular section 21.

Therefore, a central portion of the fixed core 12F is elastically supported by the elastic members 27 via the support plate 26, and upper and lower end portions of the fixed core in a longitudinal direction are elastically supported by the shock-absorbing ribs 23.

Additionally, the spool 28 is integrally formed with a coil terminal 30 fixed to a terminal base 29 projecting out from one narrow portion 21*b* of the first frame 11A.

Furthermore, at front ends of the other pair of facing side walls, for example, right and left side walls of the wide portion 21*a* of the first frame 11A, as illustrated in FIG. 3 to FIG. 7, four hook portions 31 extending forward from both end portions of the narrow portions 21*b* and 21*c* are formed at symmetric positions in the upward-downward direction and a right-left direction so that engaging portions 31*a* are turned inside.

Furthermore, attaching plate portions 32 having attaching holes are formed at four corners of the bottom portion of the bottomed square tubular section 21 of the first frame 11A.

Figure 9A:
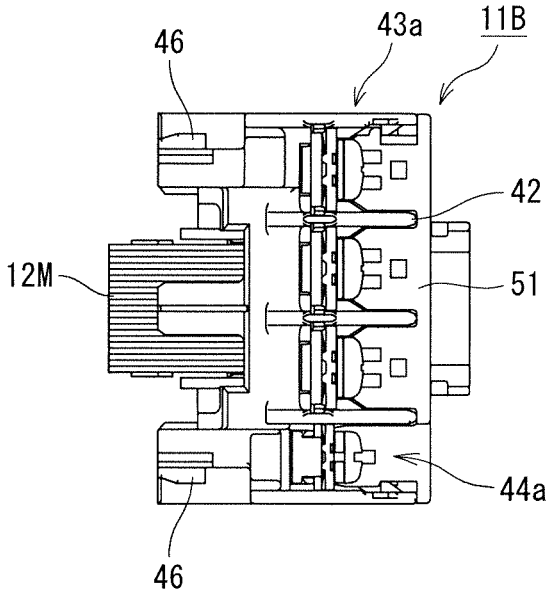
FIGS. 9A to 9C are views illustrative of a second frame.
Figure 9B:
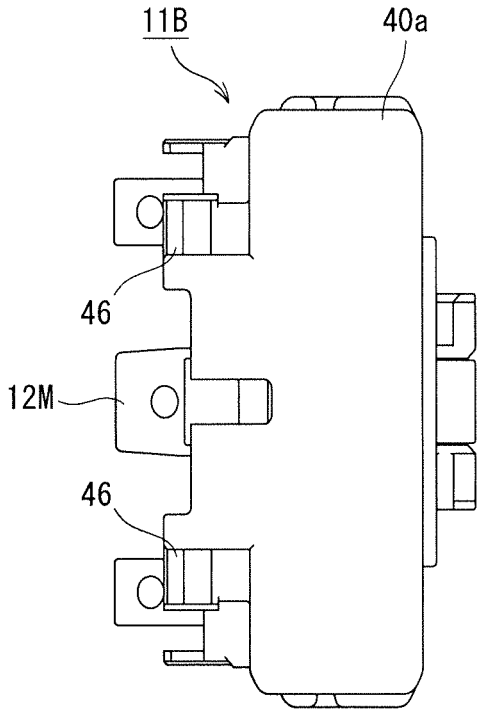
Figure 9C:
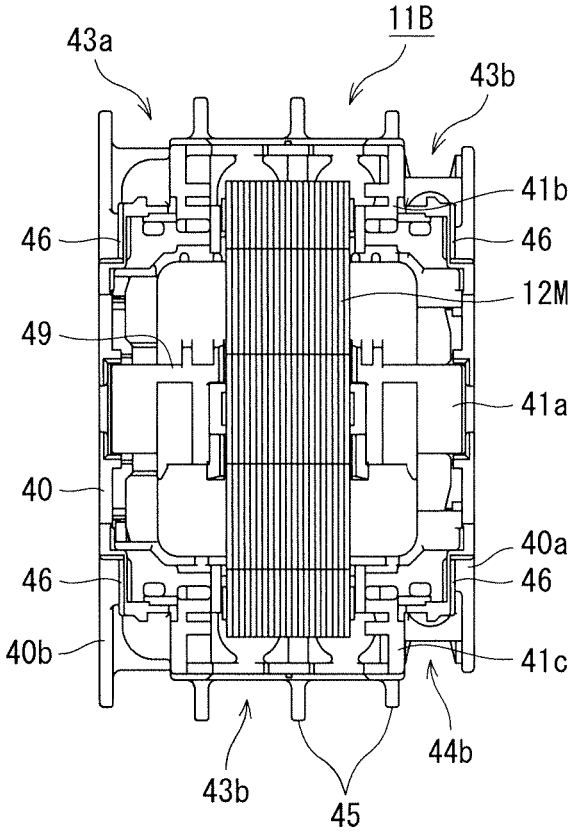

As illustrated in FIGS. 9(*a*) to (*c*), the second frame 11B includes a square tubular portion 40 in which a shape of a coupling portion side to be coupled with the first frame 11A has the same shape as in the bottomed square tubular section 21 of the first frame 11A. The square tubular portion 40 has a wide portion 41*a* and narrow portions 41*b* and 41*c* which communicate with the wide portion 41*a* in the same manner as in the bottomed square tubular section 21.

Figure 10:
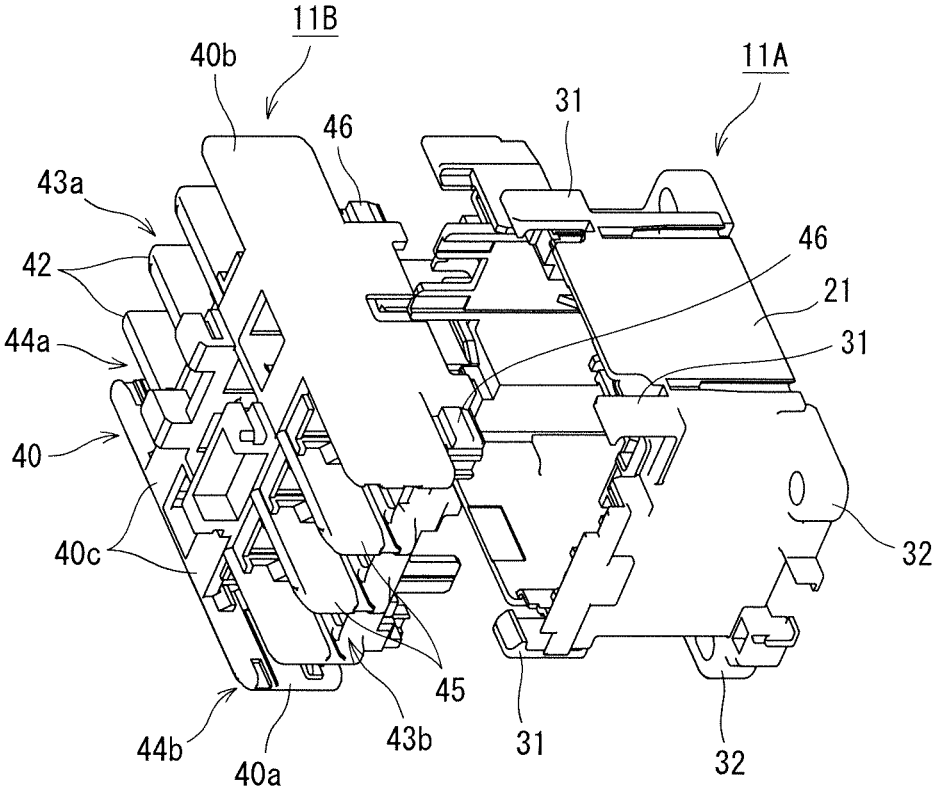
FIG. 10 is an exploded perspective view illustrative of the electromagnetic contactor of FIG. 1.

Additionally, in the square tubular portion 40, as illustrated in FIG. 10, facing side surface plate portions 40*a* and 40*b* in which the narrow portions 41*b* and 41*c* do not communicate extend on aside opposite to the coupling portion side. Coupling plate portions 40*c* bridge a space between central portions of extending end portions of the facing side surface plate portions 40*a* and 40*b*. On lower sides of the coupling plate portions 40*c*, there are formed plural, e.g., three partition walls 42 which divide a space between the facing side surface plate portions 40*a* and 40*b* in parallel so that a main circuit power source side terminal portion 43*a* and an auxiliary terminal portion 44*a* are disposed.

Additionally, on upper sides of the coupling plate portions 40*c*, there are formed plural, e.g., three partition walls 45 which divide a space between the facing side surface plate portions 40*a* and 40*b* in parallel so that a main circuit load side terminal portion 43*b* and an auxiliary terminal portion 44*b* are disposed.

Furthermore, in the facing side surface plate portions 40*a* and 40*b*, engaging projections 46 with which engaging portions 31*a* of the hook portions 31 engage from the outside are formed at four positions facing the hook portions 31 of the first frame 11A, respectively.

Further, the hook portions 31 formed in the first frame 11A and the engaging projections 46 formed in the second frame 11B constitute snap fits 47.

Additionally, an arc-extinguishing chamber 48 is formed on a back surface side of the coupling plate portions 40*c*, a contact holder 49 that holds movable contacts 49*a* is held to be slidable in the forward-backward direction in the arc-extinguishing chamber 48, a movable core 12M that faces the fixed core 12F is coupled with the back surface side of the contact holder 49, and a non-illustrated return spring is disposed between the movable core 12M and the spool 28 of the first frame 11A.

Furthermore, an arc-extinguishing cover 51 is disposed to cover upper surfaces, front surfaces and lower surfaces of the coupling plate portions 40*c*.

Further, as illustrated in FIG. 1, the first frame 11A and the second frame 11B are integrated in a state where the hook portions 31 of the first frame 11A are engaged with the engaging projections 46 of the second frame 11B.

Next, an operation of the above embodiment will be described.

Now, it is defined that an AC power source is connected to the main circuit power source side terminal portion 43*a* of the electromagnetic contactor 10 and that, for example, a three-phase electric motor is connected to the main circuit load side terminal portion 43*b*.

At this time, when the energization coil 28*a* wound around the spool 28 of the operating electromagnet 12 is in a non-energized state, as illustrated in FIG. 2, the movable core 12M is held at a front position by the non-illustrated return spring to be disposed away from the fixed core 12F.

In this state, the contact holder 49 coupled with the movable core 12M moves forward to move the movable contacts 49*a* away from a fixed contact (not illustrated), thereby making a power supply cut-off state between the main circuit power source side terminal portion 43*a* and the main circuit load side terminal portion 43*b*.

When power supply is started from this power supply cut-off state to the energization coil 28*a* wound around the spool 28 of the operating electromagnet 12, a large suction force is generated in the fixed core 12F, and this suction force brings the movable core 12M into collision with the fixed core 12F against the return spring (not illustrated).

At this time, the central portion of the fixed core 12F is elastically supported by the elastic members 27 via the support plate 26, the upper and lower end portions of the fixed core are elastically supported by the shock-absorbing ribs 23, and hence an impact force when the movable core 12M collides with the fixed core is relaxed by the elastic members 27 and the shock-absorbing ribs 23.

In this way, when the movable core 12M collides with the fixed core 12F, the contact holder 49 coupled with the movable core 12M moves backward, the movable contacts

49*a* come in contact with the fixed contact (not illustrated) to make an energized state in the main circuit power source side terminal portion 43*a* and the main circuit load side terminal portion 43*b*, and power is supplied to the three-phase electric motor.

Afterward, in a case where the three-phase electric motor is stopped, the power supply to the coil terminal 30 is stopped, thereby eliminating the suction force of the fixed core 12F. In consequence, the movable core 12M is returned to the front position illustrated in FIG. 2 by the return spring (not illustrated), and the movable contacts 49*a* move forward away from the fixed contact (not illustrated) to return to the power supply cut-off state.

Consequently, according to the above embodiment, the shock-absorbing ribs 23 which elastically support the upper and lower end portions of the fixed core 12F are formed in the bottom portion of the bottomed square tubular section 21 of the first frame 11A, and hence, to make the energized state, the impact force when the fixed core 12F sucks the movable core 12M to bring the movable core 12M into collision with the fixed core 12F can be relaxed by the elastic members 27 in the central portion of the fixed core 12F and relaxed by the shock-absorbing ribs 23 in the upper and lower end portions of the fixed core 12F.

In this case, the shock-absorbing ribs 23 are integrally formed in the bottom portion of the bottomed square tubular section 21 of the first frame 11A, an elastic member made of a shock-absorbing rubber as in the abovementioned conventional example does not have to be separately disposed, and a shock-absorbing effect can be exerted while decreasing the number of components.

Additionally, the shock-absorbing ribs 23 are integrally formed in the bottomed square tubular section 21, and hence an operation of attaching the elastic member made of the shock-absorbing rubber is not required, and the number of assembling steps can be decreased.

Additionally, the shock-absorbing ribs 23 are formed as parts of the reinforcing ribs 22 which reinforce the bottom portion of the bottomed square tubular section 21, and hence as compared with a case where shock-absorbing ribs for exclusive use are formed, integral formation can easily be carried out without noticeably changing a die.

Furthermore, the guide members 24 and 25 which guide the fixed core 12F are formed around the shock-absorbing ribs 23, and hence the fixed core 12F can be positioned so that the upper and lower end portions of the fixed core securely come in contact with the shock-absorbing ribs 23.

It is to be noted that in the above respective embodiments, there has been described the case where the first frame 11A has the bottomed square tubular section 21, but the section does not have to be square tubular, and corner portions may be circular or the section may be formed into an optional tubular shape such as a cylindrical shape or an elliptic tubular shape.

Additionally, in the above respective embodiments, there has been described the case where the hook portions 31 of the snap fits 47 are formed in the first frame 11A and the engaging projections 46 are formed in the second frame 11B, but the present invention is not limited to this case, and the engaging projections 46 may be formed in the first frame 11A and the hook portions 31 may be formed in the second frame 11B.

Additionally, in the above embodiment, there has been described the case where the electromagnetic contactor has the auxiliary terminal portions 44*a* and 44*b*, but the present invention is not limited to this case, and the present invention is also applicable to an electromagnetic contactor in which the auxiliary terminal portions 44*a* and 44*b* are omitted.

REFERENCE SIGNS LIST

10 . . . electromagnetic contactor, 11A . . . first frame, 11B . . . second frame, 12 . . . operating electromagnet, 12F . . . fixed core, 12M . . . movable core, 13 . . . contact mechanism, 21 . . . bottomed square tubular section, 22 . . . reinforcing rib, 23 . . . shock-absorbing rib, 24 and 25 . . . guide member, 26 . . . support plate, 27 . . . elastic member, 28 . . . spool, 29 . . . terminal base, 30 . . . coil terminal, 31 . . . hook portion, 40 . . . square tubular portion, 43*a* . . . main circuit power source side terminal portion, 43*b* . . . main circuit load side terminal portion, 44*a* and 44*b* . . . auxiliary terminal portion, 46 . . . engaging projection, 47 . . . snap fit, 49 . . . contact holder, 49*a* . . . movable contact, and 51 . . . arc-extinguishing cover.

The invention claimed is:

1. An electromagnetic contactor, comprising:

a first frame and a second frame which are made of a synthetic resin and coupled with each other;

an operating electromagnet in which a fixed core is fixed in the first frame and a movable core is disposed in the second frame;

shock-absorbing ribs integrally formed in a bottom portion of a bottomed tubular section of the first frame to support the fixed core of the operating electromagnet, and formed to individually support both end sides of the fixed core in a longitudinal direction, the shock-absorbing ribs including a first shock-absorbing rib disposed at a first end side of the fixed core and a second shock-absorbing rib disposed at a second end side of the fixed core; and reinforcing ribs, disposed between the first shock-absorbing rib and the second shock-absorbing rib, to protrude from the bottom portion of the bottomed tubular section of the first frame to support the fixed core of the operating electromagnet.

2. The electromagnetic contactor according to claim 1, wherein the shock-absorbing ribs are configured to extend from the reinforcing ribs, a width of each of the shock-absorbing ribs is narrower than a width of each of the reinforcing ribs, and a height of each of the shock-absorbing ribs is higher than a height of each of the reinforcing ribs.

3. The electromagnetic contactor according to claim 2, wherein a guide member which guides the fixed core is formed around the shock-absorbing ribs at a time of attaching the fixed core.

4. The electromagnetic contactor according to claim 1, wherein a guide member which guides the fixed core is formed around the shock-absorbing ribs at a time of attaching the fixed core.

* * * * *